United States Patent [19]

Schneider et al.

[11] Patent Number: 4,986,287

[45] Date of Patent: Jan. 22, 1991

[54] COAXIAL CIGARETTE

[75] Inventors: Werner Schneider, Quickborn; Horst Borowski, Hamburg; Erwin Kausch; Rolf Kütting, both of Jesteburg; Meinhard Meyer, Appen-Unterglinde; Knut Möller; Bernd-Henrik Müller, both of Hamburg; Adolf Schlüter, Quickborn, all of Fed. Rep. of Germany

[73] Assignee: B.A.T. Cigarettenfabriken GmbH, Hamburg, Fed. Rep. of Germany

[21] Appl. No.: 423,310

[22] Filed: Oct. 18, 1989

[30] Foreign Application Priority Data

Oct. 24, 1988 [DE] Fed. Rep. of Germany ..... 3836210

[51] Int. Cl.[5] ..... A24D 1/00; A24D 1/02; A24D 1/18

[52] U.S. Cl. ..... 131/360; 131/361; 131/364; 131/365; 131/352; 131/336; 131/359

[58] Field of Search ..... 131/364, 336, 361, 360, 131/365, 359

[56] References Cited

U.S. PATENT DOCUMENTS

| | | | |
|---|---|---|---|
| 3,614,956 | 10/1971 | Thornton . | |
| 4,219,031 | 8/1980 | Rainer et al. . | |
| 4,874,004 | 10/1989 | Borowski et al. | 131/364 |

FOREIGN PATENT DOCUMENTS

| | | |
|---|---|---|
| 3602846A1 | 8/1986 | Fed. Rep. of Germany . |
| 3743597C1 | 2/1989 | Fed. Rep. of Germany . |
| 988556 | 8/1951 | France . |
| 1322254 | 2/1963 | France . |
| 1086443 | 10/1967 | United Kingdom . |
| 2070409 | 9/1981 | United Kingdom . |

*Primary Examiner*—V. Millin

*Attorney, Agent, or Firm*—Armstrong, Nikaido, Marmelstein, Kubovcik & Murray

[57] ABSTRACT

A coaxial cigarette comprising an inner core of a material glowing away substantially without residue, in particular tobacco material, with a sheath for the inner core, an outer jacket coaxially surrounding the inner core and its sheath and comprising a tobacco and/or non-tobacco material, and a sheath for the outer jacket, has a diameter of the inner core which lies in the range from 45% to 80% of the outer diameter of the coaxial cigarette; the inner core has a packing density in the range from 300 to 400 mg/cm$^3$; the outer jacket has a packing density in the rnage from 170 to 250 mg/cm$^3$. The sheath of the inner core has an air permeability of less than 3 ISO units. The outer sheath has a front segment to be lit and a rear mouth-side segment; the front ignition-side segment of the outer sheath contains conventional glow salts and has an air permeability of 15 to 40 ISO units and the rear mouth-side segment of the outer sheath contains no glow salts and has an air permeability of less than 3 ISO units.

15 Claims, 1 Drawing Sheet

COAXIAL CIGARETTE

BACKGROUND OF THE INVENTION

1. Field of the Invention

The invention relates to a coaxial cigarette comprising an inner core of a material burning substantially free of residue, In particular tobacco material, a sheath for the inner core, an outer jacket of a tobacco and/or non-tobacco material coaxially surrounding the inner core of the sheath thereof and a sheath for the outer jacket.

2. Description of the Prior Art

A number of publications exist on so-called "coaxial smokable articles", i.e., in particular coaxial cigars or cigarettes having an inner core which is surrounded by a jacket or shell of tobacco material. The fundamental principle of such a coaxial cigarette is known, for example, from French patent specification 998,556, the inner core consisting of tobacco of lower quality which is surrounded by an annular jacket of tobacco of high quality. This makes it possible to achieve savings in the costs of the tobacco materials used.

Further developments of such coaxial cigarettes are disclosed in French patent specification 1,322,254, U.S. Pat. No. 3,614,956 and 4,219,031, British patent publication 2,070,409 and British patent specification 1,086,443.

A coaxial cigarette of the type indicated is, for example, known from German patent publication 3,602,846 and comprises an inner core of a material which burns free of residue, in particular tobacco material, a sheath for the inner core, an outer jacket of a tobacco and/or non-tobacco material coaxially surrounding the inner core and a sheath for the outer jacket or shell. The particular advantage of this coaxial cigarette resides in that it can be made with the usual production techniques on specially adapted rod machines.

In a further development of this coaxial cigarette an embodiment is described in U.S. patent application Ser. No. 281,640 of Dec. 12, 1988 which is provided with a filter to trap the undesired smoke constituents.

However, such a filter often influences the parameter of such a cigarette which is essential to the smoker, namely its flavour, so that the reduction of the condensate is achieved at the expense of loss of flavour. On the other hand, (filterless) rod cigarettes are preferred by smokers, for example, due to their flavour and their "image".

SUMMARY OF THE INVENTION

The invention therefore has as its object the provision of a coaxial cigarette of the specified category in which the aforementioned disadvantages do not occur.

More particularly, it is intended to propose a coaxial cigarette which even without filter but under standard smoking conditions furnishes a nicotine-free dry condensate of less than 15 mg per cigarette whilst simultaneously offering satisfactory smoke per puff and substantially less CO yield per puff and providing a reduction of the secondary smoke stream generated per unit time during pauses between puffs.

The invention therefore proposes in a coaxial cigarette comprising an inner core of a material burning substantially free of residue, in particular tobacco material, a sheath for the inner core, an outer jacket of a tobacco and/or non-tobacco material coaxially surrounding the inner core or the sheath thereof and a sheath for the outer jacket, the improvement in which the diameter of the inner core lies in the range from 45% to 80% of the outer diameter of the coaxial cigarette, the inner core has a packing density in the range from 300 to 400 mg/cm$^3$, the sheath of the inner core has an air permeability of less than 3 ISO units, the outer jacket has a packing density in the range from 170 to 250 mg/cm$^3$, the outer sheath comprises a front segment to be ignited and a rear mouth-side segment, the front ignition-side segment of the outer sheath contains conventional glow salts and has an air permeability of 15 to 40 ISO units, and the, rear mouth-side segment of the outer sheath contains no glow salts and has an air permeability of less than 3 ISO units.

Advantageous forms of embodiment are defined by the features of the subsidiary claims.

The advantages achieved with the invention are due to a matching of the various properties of the inner core and the outer jacket and their sheaths for optimization so that whilst retaining the appearance and format of conventional rod cigarettes a flavour-relevant smoke yield per puff is achieved, expressed by the index "condensate value per cigarette divided by the number of puffs", which is comparable to the smoke yield of conventional filter cigarettes with a richer content this being done without using a filter. Of course, if required a filter may additionally be provided to reduce the condensate value still further.

In addition, compared with the rod cigarettes on the market a substantially lesser carbon monoxide yield results, this being achieved without using the hitherto usual high rod ventilation by perforation zones but simply with a cigarette paper of low to medium air permeability.

In this case as well the already very low carbon monoxide yield achieved can be still further reduced by using perforation zones made mechanically or by laser beams.

A substantially lower carbon monoxide yield is also achieved compared with filter cigarettes of similar condensate yield.

The matching of the various properties further ensures an extremely low glowing rate not implementable with conventional cigarettes without any danger of a cigarette going out of its own accord once lit. This gives two essential advantages, i.e.

(a) a reduction of the secondary smoke generated per unit time during the intervals between puffs and (b) a reduction of the danger of combustible material igniting on the glow cone of this coaxial cigarette.

The extremely low glowing rate achievable further ensures an extremely high burning rate/glowing rate ratio not implementable with conventional cigarettes. As a result the tobacco used can be more effectively utilized for smoking pleasure because in the glowing phases less tobacco smoulders uselessly away than with conventional cigarettes.

This coaxial cigarette can be combined if required with suitable mouthpieces. For example, a mouthpiece with very low filtration power and very low draw resistance would be conceivable.

BRIEF DESCRIPTION OF THE DRAWINGS

The invention will be described in more detail hereinafter with the aid of an example of embodiment with reference to the accompanying schematic drawings, wherein.

DESCRIPTION OF THE PREFERRED EMBODIMENTS

Figure 1:
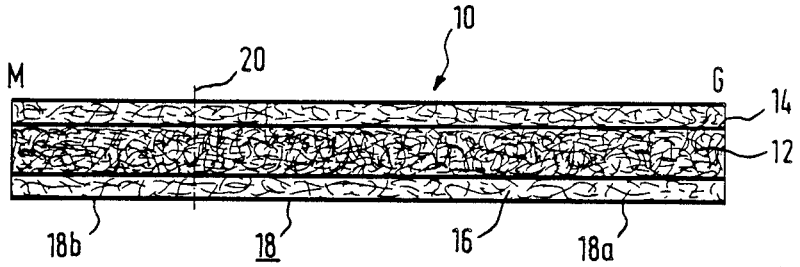
FIG. 1 is an axial section through a coaxial cigarette.

The coaxial cigarette indicated generally by the reference numeral 10 comprises an inner core 12 having a sheath 14 and an outer jacket 16 with a sheath 18.

The mouth-side end, on the left in the illustration of FIG. 1, is denoted by the letter M whilst the right end to be lit is denoted by the letter G (glow).

Said coaxial cigarette 10 has the appearance and format of conventional cigarettes consisting of a single rod, the inner core 12 and the outer jacket 16 each being homogeneous over their entire length and containing conventional tobacco mixtures and/or other combustible or heat-decomposable materials.

The diameter of the inner core 12 lies in the range from 45 to 80%, in particular 50 to 75%, of the outer diameter of the coaxial cigarette 10 which has the usual value, i.e. is about 8 mm.

The inner sheath 14 of the inner core 12 consists of a cigarette paper, preferably made from tobacco plants, or a foil of tobacco material. The air permeability of the entire inner sheath 14 of the inner core 12 is less than 3 ISO units, i.e. the units defined by the DIN ISO standard 2965 for the air permeability of cigarette paper expressed by the equation:

$$\text{Air permeability } P = \frac{Q}{S \cdot \Delta P}$$

In this equation

Q=the volume flow of air traversing the test specimen in $cm^3$/min.

S=test area of the test specimen used in the test in $cm^2$

ΔP=pressure difference between the two surfaces of the test specimen in kPa

The packing density of the inner core 12 lies in the range from 300 to 400 $mg/cm^3$ whilst the packing density of the outer jacket 16 lies in the range from 170 to 250 $mg/cm^3$.

The outer sheath 18 of the outer jacket 16 consists of two separate segments, of which the division line is indicated by the reference numeral 20 in FIG. 1.

The front ignition-side segment **18*a* of the outer sheath 18, which extends from the division line 20 up to the end G of the coaxial cigarette 10**, has a length of at the most 50 mm and contains conventional glow salts, i.e. the glow salts usual in the cigarette industry with the usual concentrations.

The air permeability of this front ignition-side segment **18*a* of the outer sheath 18** lies in the range from 15 to 40, in particular 20 to 25 ISO units.

The rear mouth-side segment **18*b* of the outer sheath 18 contains no glow salts and if necessary can even be provided with glow-inhibiting substances. The air permeability of the mouth-side segment 18*b* of the outer sheath 18** is less than 3 ISO units.

In contrast to other filterless cigarettes in this coaxial cigarette 10 it is essential that it is indeed lit at the end G and the end M is put into the mouth. If the respective ends cannot perhaps be satisfactorily recognised the mouthside end M must be clearly marked as the rod end which must be inserted into the mouth by means of a corresponding marking, for example a colour marking or an imprint.

If by mistake the end M of the coaxial cigarette 10 is lit it soon goes out.

The two segments **18*a*, 18*b* of the outer sheath 18** may either be made in one piece or consist of two separate parts.

To simplify the cigarette production it is possible, deviating from the embodiment according to FIG. 1, for the outer ignition-side segment **18*a* of the outer sheath 18 to surround the outer jacket 16 over its entire length; the important point is only that then in addition the rear segment 18*b* is also provided which is disposed on or beneath the sheath 18*a***.

The rod draw resistance per unit length of the entire front ignition-side segment **18*a*** must lie in the range from 15 to 20 mm WC/cm.

If the aim in the cigarette design is to achieve a high number of puffs using cigarette papers of very low air permeability, a physically defined limit exists in that low air permeability leads to glowing rates which are too low and this involves the risk of a glowing cigarette soon going out.

The lower limit for the glowing rate of a cigarette which does not go out of its own accord is considered to be a glowing rate of more than 3 mm/min (V. Norman, Coresta, Vienna, 1984). Typical glowing rates of conventional cigarettes lie in the range of 4 to 7 mm/min.

By the parameters given above the coaxial cigarette 10 may be adapted in such a manner that the glowing rate of the coaxial cigarette 10 is less than 2 mm/min.

Figure 2:
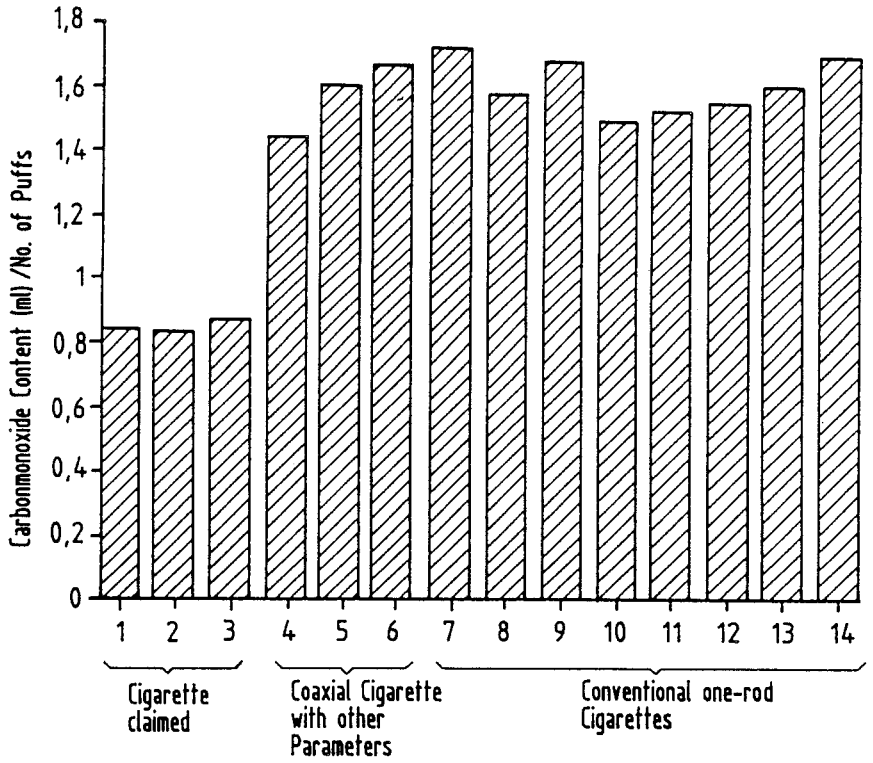
FIG. 2 is a histogram of the carbon monoxide yield-/number of puffs ratio for various cigarette specimens.

FIG. 2 represents in the form of a histogram the carbon monoxide yield in milliliters (ml) per number of puffs for various cigarette specimens.

The three columns 1, 2 and 3 on the left of the illustration of FIG. 2 show the carbon monoxide content/number of puffs for three filterless coaxial cigarettes 10 of which the parameters have been defined above; it is apparent that the carbon monoxide content per number of puffs lies only slightly above 0.8 ml and thus has an extremely low value.

Apart from the value for the three coaxial cigarettes 1, 2 and 3 according to the invention FIG. 2 also shows the carbon monoxide contents for three coaxial cigarettes 4, 5 and 6 which do not fulfil the aforementioned parameters; these are therefore coaxial cigarettes which likewise have an inner core with sheath, an outer core and the two outer sheaths but with regard to the specifications lie outside the ranges claimed. It can be seen that the carbon monoxide yield of these coaxial cigarettes is more than 1.4 ml per puff, i.e. is substantially higher than with the coaxial cigarettes according to the invention.

The specimens 7 to 14 relate finally to conventional one-rod filterless cigarettes as available on the market. In this case as well the carbon monoxide yields are between 1.4 and 1.6 ml per puff, i.e. they are substantially higher than with the coaxial cigarettes according to the invention.

These results were obtained without filter and can therefore be still further improved by attaching a filter or alternatively by greater ventilation.

We claim:

1. A coaxial cigarette comprising (a) an inner core of a material burning substantially free of residue, (b) a sheath for the inner core, (c) an outer jacket of a tobacco and/or non-tobacco material coaxially surrounding the inner core or the sheath thereof and (d) a sheath for the outer jacket, wherein (e) the diameter of the inner core lies in the range from 45% to 80% of the outer diameter of the coaxial cigarette;

(f) the inner core has a packing density in the range from 300 to 400 mg/cm$^3$;

(g) the sheath of the inner core has an air permeability of less than 3 ISO units;

(h) the outer jacket has a packing density in the range from 170 to 250 mg/cm$^3$;

(i) the outer sheath comprises a front segment to be ignited and a rear mouth-side segment;

(j) the front ignition-side segment of the outer sheath contains glow salts and has an air permeability of 15 to 40 ISO units; and (k) the rear mouth-side segment of the outer sheath contains no glow salts and has an air permeability of less than 3 ISO units.

2. A coaxial cigarette according to claim 1, wherein the inner core and/or the outer jacket contain tobacco mixtures and/or other combustible or heat-decomposable materials.

3. A coaxial cigarette according to claim 1, wherein the diameter of the inner core lies in the range from 50% to 75% of the outer diameter of the coaxial cigarette.

4. A coaxial cigarette according to claim 1, wherein the air permeability of the front ignition-side segment of the sheath is 20 to 25 ISO units.

5. A coaxial cigarette according to claim 1, wherein the rear mouth-side segment of the sheath contains glow-inhibiting substances.

6. A coaxial cigarette according to claim 1, wherein the mouth-side rear segment is denoted by a marking, in particular has a different colour than the front segment and/or an imprint.

7. A coaxial cigarette according to claim 1, wherein the front ignition-side segment of the sheath extends over the entire length of the coaxial cigarette and at the mouthside end the rear mouth-side segment of the sheath is additionally provided.

8. A coaxial cigarette according to claim 1, wherein the front ignition-side segment of the sheath has a length of at the most 50 mm.

9. A coaxial cigarette according to claim 1, wherein the front ignition-side segment and the rear mouth-side segment of the sheath consist of cigarette paper.

10. A coaxial cigarette according to claim 1, wherein the inner sheath consists of cigarette paper, in particular of cigarette paper made from tobacco plants, or of a foil of tobacco material.

11. A coaxial cigarette according to claim 1, wherein the draw resistance per unit length of the entire front ignitionside segment lies in the range from 15 to 20 mm WC/cm.

12. A coaxial cigarette according to claim 1 in combination with a filter.

13. A coaxial cigarette according to claim 12, wherein the filter has a very low filtration power and a very low draw resistance.

14. A coaxial cigarette according to claim 1, wherein the two segments of the outer sheath are made in one piece.

15. A coaxial cigarette according to claim 1, wherein the two segments of the outer sheath consist of separate parts.

* * * * *